United States Patent [19]
Yosimura
[11] 4,371,227
[45] Feb. 1, 1983

[54] ELECTRIC CONNECTOR

[75] Inventor: Yosikazu Yosimura, Ohsaki, Japan
[73] Assignee: Hirose Electric Co., Ltd., Tokyo, Japan

[21] Appl. No.: 178,006
[22] Filed: Aug. 14, 1980
[30] Foreign Application Priority Data
Apr. 19, 1979 [JP] Japan ..... 54-53822[U]
[51] Int. Cl.³ ..... H01R 13/05; H01R 13/432
[52] U.S. Cl. ..... 339/211; 339/217 S
[58] Field of Search ..... 339/211, 217 S

[56] References Cited

U.S. PATENT DOCUMENTS 2,938,190 5/1960 Krehbiel ..... 339/217 S X
3,950,070 4/1976 Groft et al. ..... 339/217 S

*Primary Examiner*—Eugene F. Desmond
*Attorney, Agent, or Firm*—Brumbaugh, Graves, Donohue & Raymond

[57] ABSTRACT

In an electric connector comprising a pair of mating parts adapted to be coupled to each other, corresponding contact elements disposed in the housings of the mating parts have same shape and dimensions. Each of the contact elements has a main body in the form of a channel and a plate-like member upwardly and rearwardly extending from the forward end of the bottom wall of the main body. The rearward end of the main body forms a connecting section for an electric wire to be terminated. The outer surface of the forward portion of the bottom wall of the main body forms a planar contacting section. The plate-like member is provided with an upwardly convex spring contact. In the housing of one of the mating parts, the contact element is arranged in the contact element groove of the housing so that the planar contacting section of the contact element is exposed to the exterior of the groove and the convex spring contact of the contact element faces to the bottom wall of the groove.

In the housing of the other mating part, the contact element is arranged in the contact element groove of the housing so that the convex spring contact of the contact element is exposed to the exterior of the groove.

When the mating parts are coupled to each other, the outwardly convex spring contact of the contact element in the other mating part makes contact with the planar contacting section of the contact element in the one mating part.

2 Claims, 5 Drawing Figures

ELECTRIC CONNECTOR

BACKGROUND OF THE INVENTION

1. Field of the Invention

This invention relates to an electric connector and more particularly to an electric connector of the type having sexless contact elements.

2. Description of the Prior Art

In the past, there were electric connectors of the type having sexless contact elements. The contact elements in these electric connectors make contact with each other at their curved spring contacts. Therefore, the contacting pressure and contacted area between the contact elements making contact with each other depend on the coupling depth thereof. If these electric connectors are used for a plug-in type connector wherein the coupling depth tends to vary upon every coupling, inconveniently the contacting pressure and contacted area between the contact elements changed due to variation of the coupling depth. Particularly, in multicontact connectors, this would lead to a large variation in force required for coupling or decoupling the connector.

Therefore, it is an object of this invention to eliminate the above described drawbacks in the prior connectors and provide an electric connector wherein the contacting pressure and contacted area between the contact elements can be kept constant, independently of the coupling depth thereof, whereby a stable coupling can be achieved consistently.

SUMMARY OF THE INVENTION

An electric connector according to this invention comprises a pair of mating parts adapted to be coupled to each other, and contact elements disposed in the housings of the mating parts having same shape and dimensions, each of the contact elements having a main body in the form of a channel and a plate-like member upwardly and rearwardly extending from the forward end of the bottom wall of the main body, the rearward end of the main body forming a connecting section for an electric wire to be terminated, the outer surface of the forward portion of the bottom wall of the main body forming a planar contacting section, the plate-like member being provided with an upwardly convex spring contact, the contact element being arranged in a contact element groove of the housing of one of the mating parts so that the planar contacting section of the contact element is exposed to the exterior of the groove and the convex spring contact of the contact element faces to the bottom wall of the groove, the contact element being arranged in a contact element groove of the housing of the other mating part so that the convex spring contact of the contact element is exposed to the exterior of the groove, whereby the outwardly convex spring contact of the contact element in the other mating part can make contact with the planar contacting section of the contact element in the one mating part when the mating parts are coupled to each other.

This invention will be described in further detail in connection with an embodiment as illustrated in the accompanying drawings.

DESCRIPTION OF THE PREFERRED EMBODIMENTS

Figure 1:
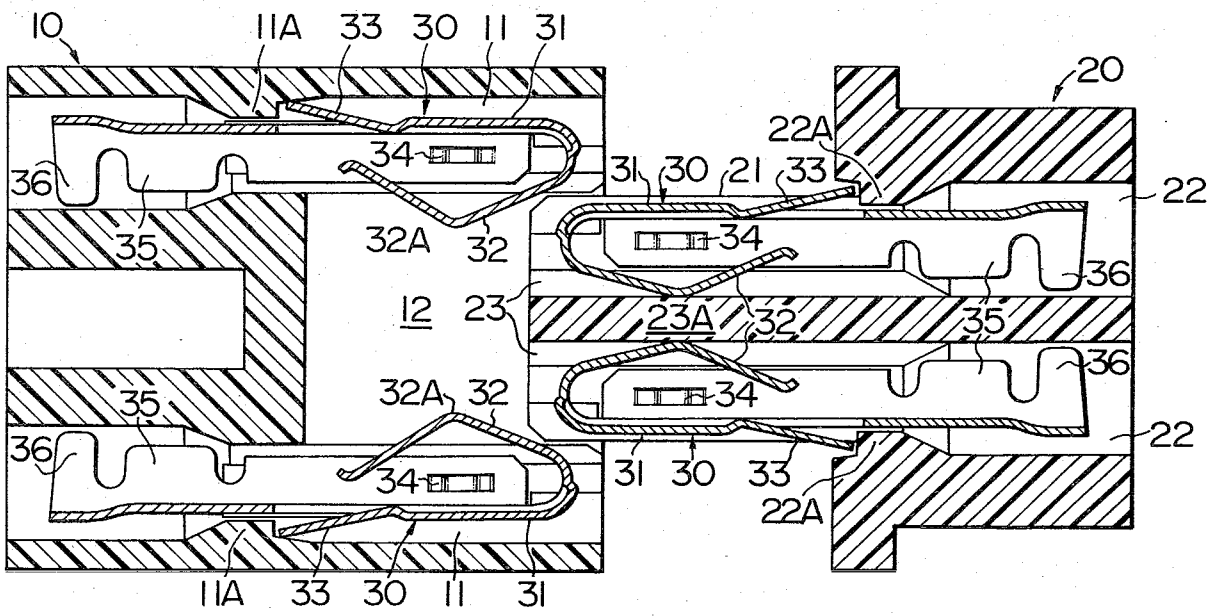
FIG. 1 is a sectional view of an electric connector according to this invention just before being coupled.

Referring now to FIG. 1, there is shown an embodiment of the electric connector according to this invention. The electric connector comprises a pair of mating parts. One of the mating parts is a receptacle having an insulating housing 10, and the other mating part is a plug having an insulating housing 20. The housing 10 is provided with two rows of contact element grooves 11. The housing 20 is provided with a projection 21. The housing 10 is also provided with a plug receiving aperture 12 for receiving the projection 21 of the housing 20. The inner walls of the contact element grooves 11 have protrusions 11A formed generally at their intermediate portions, which protrusions are for the purpose of latching a sexless contact element. A sexless contact element 30 having a planar contacting section 31 and a spring contact 32 is arranged in the contact element grooves 11 so that the spring contact 32 may project into the plug receiving aperture 12.

On the other hand, the housing 20 of the plug is provided with two rows of contact element receiving openings 22 and at the projection 21 with two rows of contact element grooves 23 communicating with the openings 22 respectively. At junctures of the contact element receiving openings 22 and the contact element grooves 23, protrusions 22A are provided for latching a sexless contact element. A sexless contact element 30 having a planar contacting section 31 and a spring contact 32, which contact element is identical with the sexless contact element described before, is arranged in the openings 22 and the grooves 23 so that the planar contacting section 31 may be positioned in the outer periphery of the projection 21, namely so that the planar contacting section 31 may be exposed to the exterior of the contact element groove 23 and the spring contact 32 may be pressed against the bottom wall 23A of the contact element groove 23.

Figure 3:
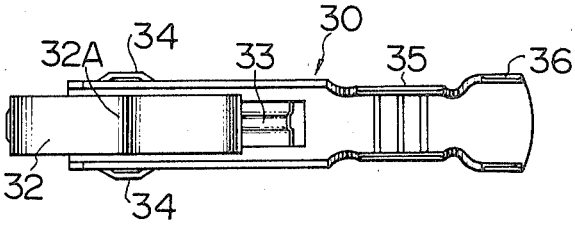
FIG. 3 is a plan view of a contact element as used in the electric connector of FIG. 1.
Figure 4:
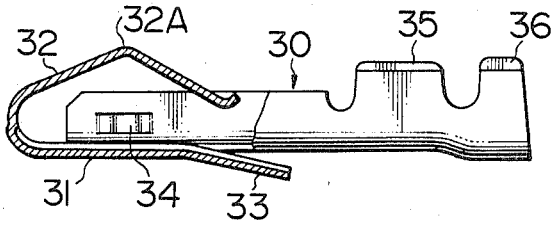
FIG. 4 is a partially sectional front view of the contact element of FIG. 3.
Figure 5:
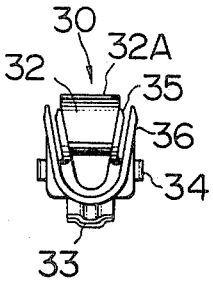
FIG. 5 is a right side view of the contact element of FIG. 3.

The sexless contact element 30 is shown in detail in FIGS. 3, 4 and 5. In this embodiment, the contact element 30 is formed of an electrically conductive and resilient metal sheet by stamping or pressing. The contact element 30 has a main body in the form of a channel, the forward, intermediate and rear portions of which form a contacting section, a latching section and a connecting section respectively, and a plate-like member upwardly and rearwardly extending from the forward end of the bottom wall of the main body. The outer surface of the forward portion of the bottom wall of the main body forms the planar contacting section 31, and the plate-like member forms the upwardly convex spring contact 32.

The latching section comprises a latching tongue 33 formed by partially cutting and pushing out a portion of the bottom wall of the channel-shaped main body. The side walls of the channel-shaped main body are provided with latching protrusions 34 outwardly embossed. As described before, the function of the latching tongue 33 and the latching protrusions 34 is to secure the contact element 30 in place when the contact element 30 is inserted into the contact element groove 11 in the insulating housing 10 or the contact element receiving opening 22 and the contact element groove 23 in the insulating housing 20. Particularly, when the contact element 30 is inserted into the contact element groove 11 of the insulating housing 10, the latching tongue 33 engages the latching protrusion 11A and the latching protrusions 34 engage the inner wall of the contact element groove 11 to thereby fix the contact element in place within the contact element groove 11. On the other hand, when the contact element 30 is inserted into the contact element receiving opening 22 and the contact element groove 23 of the insulating housing 20, the latching tongue 33 engages the latching protrusion 22A and the latching protrusions 34 engage the inner wall of the contact element groove 23 to thereby fix the contact element 30 in place.

The conecting section of the contact element 30 comprises a core crimping portion 35 having a generally U-shaped section for electric connection of the core of an electric wire to be terminated and a core insulation crimping portion 36 for holding the wire.

Figure 2:
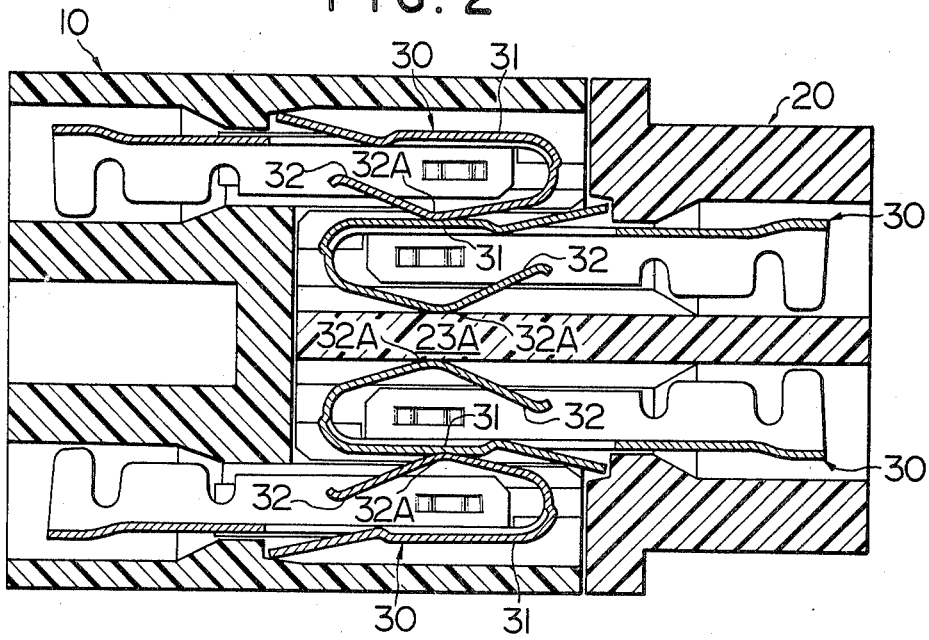
FIG. 2 is a sectional view of the electric connector of FIG. 1 after completely coupled.

FIG. 2 show the electric connector of FIG. 1 after completely coupled by further insertion of the plug into the receptacle. In this condition, the outwardly convex contacts 32A of the spring contacts 32 of the contact elements 30 in the insulating housing 10 of the receptacle make resiliently press contact with the planar contacting sections of the contact elements 30 in the insulating housing 20 of the plug. A cooperative function of the pressing force exerted by the spring contacts of the contact elements in the receptacle and the reactive force exerted by the spring contacts of the contact elements in the plug being pressed against the bottom walls 23A keeps this press contact of the convex contacts 32A with the planar contacting sections 31 stable without being adversely influenced from external vibrations or shocks.

As seen from the above, in the electric connector of this invention, although the contact elements have same shape and dimension, namely are sexless, the contact elements make contact with each other at their corresponding convex contact and planar contacting section. For this reason, a small change in the coupling depth of the receptacle and plug leads only to a small change in the position along the planar contacting section at which position the convex contact makes contact with the planar contacting section, thereby causing almost no change in the contacting pressure and contacted area between the contacts elements coupled. Therefore, the electric connector of this invention can be conveniently used for a plug-in type connector wherein the coupling depth tends to vary upon every coupling, because the contacting pressure and contacted area between the contact elements are not caused to change due to variation of the coupling depth.

I claim:

1. An electric connector comprising a pair of mating parts adapted to be coupled to each other, and contact elements disposed in the housings of said mating parts having same shape and dimensions, each of said contact elements having a main body in the form of a channel and a plate-like member upwardly and rearwardly extending from the forward end of the bottom wall of said main body, the rearward end of said main body forming a connecting section for an electric wire to be terminated, the outer surface of the forward portion of the bottom wall of said main body forming a planar contacting section, a portion of the bottom wall of the channel-shaped main body between the connecting section and the planar contacting section being cut and pushed out to provide a latching tongue, the side walls of the portion of the channel-shaped main body the bottom wall of which forms the planar contacting section being provided with latching protrusions outwardly embossed, said plate-like member being provided with an upwardly convex spring contact, the contact element being inserted into a contact element groove of the housing of one of said mating parts so that said planar contacting section of the contact element is exposed to the exterior of the groove and said convex spring contact of the contact element faces to the bottom wall of the groove, the latching tongue engaging a latching protrusion of said one housing and the outwardly embossed latching protrusions of said connector element engaging the inner wall of the contact element groove thereby fixing the contact element in place in the contact element groove and substantially resisting angular movement of said planar contacting section relative to the housing, the contact element being inserted into a contact element groove of the housing of the other mating part so that said convex spring contact of the contact element is exposed to the exterior of the groove, the latching tongue engaging a latching protrusion of said other housing and the outwardly embossed latching protrusions of said connector element engaging the inner wall of the contact element groove thereby fixing the contact element in place in the contact element groove and substantially resisting angular movement of said planar contacting section relative to said housing, whereby said outwardly convex spring contact of the contact element in the other mating part can make contact with said planar contacting section of the contact element in the one mating part and the convex spring contact of the contact element in said one mating part makes press contact with the bottom wall of the contact element groove in the housing of said one mating part, when said mating parts are coupled to each other.

2. An electric connector as claimed in claim 1 wherein the housing of said one mating part is in the form of a plug having a projection, said contact element groove being provided in both side walls of said projection, and the housing of said other mating part is in the form of a receptacle having a receiving aperture for receiving said projection of said plug, said contact element groove being provided in both inner walls of said receiving aperture.

* * * * *